US007645179B2

(12) United States Patent
Redenius

(10) Patent No.: US 7,645,179 B2
(45) **Date of Patent: *Jan. 12, 2010**

(54) ADJUSTABLE LIFT SYSTEM FOR BRAS

(76) Inventor: Ronald Redenius, P.O. Box 402, Citrus Heights, CA (US) 95611

( * ) Notice: Subject to any disclaimer, the term of this patent is extended or adjusted under 35 U.S.C. 154(b) by 0 days.

This patent is subject to a terminal disclaimer.

(21) Appl. No.: 12/254,556

(22) Filed: Oct. 20, 2008

(65) Prior Publication Data

US 2009/0042477 A1 Feb. 12, 2009

(51) Int. Cl.
*A41D 3/00* (2006.01)

(52) U.S. Cl. ..... 450/60; 450/63; 2/67

(58) Field of Classification Search ..... 450/59–63, 450/65, 67, 68, 92, 93, 78; 2/67, 73, 78.1–78.4, 2/104–105, 113–115, 90
See application file for complete search history.

(56) References Cited

U.S. PATENT DOCUMENTS 2,407,574 A * 9/1946 Panes ..... 450/68
7,452,260 B2 * 11/2008 Redenius ..... 450/63
7,497,760 B2 * 3/2009 Redenius ..... 450/60

FOREIGN PATENT DOCUMENTS

DE 898282 7/1949

* cited by examiner

*Primary Examiner*—Gloria Hale
(74) *Attorney, Agent, or Firm*—Waters Law Group, PLLC; Robert R. Waters; Brian W. Foxworthy

(57) ABSTRACT

A lifting and shaping system for a bra or other garment uses lift platforms shaped to fit into the cups of the bra and formed from thin material. The lift platforms are attached to the garment toward the center of the garment. Connectors having one end attached to the lift platform and the other end attached to a slide on the shoulder strap adjust the lift of the lift platform when the slide is moved. Flexible shaping members distribute the lift of the lift platforms and maintain the natural shape of the breasts as they are lifted. Smoothing shields ease the movement of the lift platforms and connectors within the cloth confines of the breast cups. The flexible shaping members may also perform some of the functions of a smoothing shield.

14 Claims, 6 Drawing Sheets

ADJUSTABLE LIFT SYSTEM FOR BRAS

RELATED U.S. APPLICATION DATA

This application claims priority from U.S. Provisional application 60/579,566, filed on Jun. 14, 2004, and U.S. patent application Ser. No. 11/059,194 filed Feb. 16, 2005 for an Adjustable Lifting Bra now issued as U.S. Pat. No. 7,452,260. This application relates to an adjustable lift system for bras and other garments. The entire disclosure contained in U.S. provisional application 60/579,566 and U.S. Pat. No. 7,452,260, including the attachments thereto are incorporated herein by reference.

FIELD OF THE INVENTION

This invention relates generally to lift systems in brassieres, or bras. Specifically, this invention relates to a bra which both lifts and pushes out the breasts for an improved visual presentation while also being adjustable in the degree of push-out and lift, and comfortable to the wearer.

BACKGROUND OF THE INVENTION

Bras are a common article of clothing worn by women to support and shape their breasts. Of course, the predominant element of bras are the breast cups. The other elements of the bra are essentially present to locate and support the breast cups. These elements may include a chest band to which the breast cups are attached, and shoulder straps stretching from the breast cups, over the shoulders to the back of the chest band. Alternatively, a bra may be structured to where the breast cups, again the predominant feature, are integral to the support structure of the bra where a back band is attached to each breast cup and proceeds to the back while a center panel joins the breast cups at the center, and the previously mentioned shoulder straps pass from the breast cups over the shoulders to the back bands in the back. In this case the breast cups are themselves part of the chest band. Whether a bra has a single chest band or separate bands running from the breast cups to the back, the bra frequently has a clasp in it for greater ease in dressing. The clasp may be in the back or in the front between the cups. Adjusting buckles associated with the band and the two straps provide adjustments for different body sizes as wells as some adjustment for breast size. While bras themselves are an article of clothing, other types of women's clothing may perform the function of bras and therefore have some, or all, of the elements of the structure of bras, which is to say they will have breast cups and supporting and positioning elements for the breast cups incorporated into the garment. So, while the embodiments discussed later may reference bras, the lift system of the present invention can be applied to any women's garment with breast cups, and any women's garment having breast cups could incorporate the system.

As a matter of cosmetic enhancement, it is sometimes desired to lift the breasts up and push them forward from the body, or toward each other to emphasize cleavage. As a matter of comfort, it is preferred that this be accomplished without excessively squeezing, or otherwise unnaturally constricting the breasts. Various methods are used to accomplish this lift and push-out. Among them are wire frames around the cups, padding in the cups, and additional straps to lift the cups with some variations pulling the cups towards each other.

The history of the brassiere, most commonly know as the bra, reveals that its form and purpose have been shaped by the current fashion trend. Along with the many changes to this female undergarment comes a debate over who should be credited with the creation of the modern bra. Few disagree that the bra dates as far back as 2,500 BC, when Minoan women on the Greek island of Crete wore a garment similar to a bra, which lifted their busts out of their clothes, leaving them exposed. The custom of ancient Greek and Roman women, to minimize bust size, completely reversed the Minoan trend. To minimize their chest size, these women strapped bands over their busts to rein them in.

The debate over the true inventor of the modern bra has not been entirely resolved. A gentleman named Hoag Levins spent a great deal of time in the U.S. Patent Office doing research for a book and concluded that Marie Tucek obtained a patent for the first brassiere in 1893. She named her invention the "breast supporter," because it had separate pockets for each, straps that went over the shoulders, and hook-and-eye fasteners in the back. Unfortunately, Marie never marketed her invention, which very much resembled the modern bra.

In 1913, Mary Phelps Jacob, a.k.a. Caresse Crosby, a New York socialite who is credited with inventing the first modern bra, invented it out of necessity. The undergarment at that time consisted of a corset stiffened by whaleback bones, that would simply ruin the appearance of Mary's new gown. She enlisted the help of her French maid, Marie, and together they fashioned a backless brassiere from two handkerchiefs, ribbon and cord.

The bra, not Mary, was the belle of the ball, and Mary began sewing bras for her friends and family. When she received a request for a bra from a stranger, who enclosed money for the undergarment, dollar signs flashed in her eyes. Mary grabbed her sketches and headed straight for the U.S. Patent Office. The Office granted the patent for the "Backless Brassiere" to Mary in November 1914. After making several hundred bras, and selling few, Mary closed the doors to her young business. She sold her rights to the brassiere to the Connecticut based Warner Brothers Corset Company for $1,500.

Since Mary's basic bra arrived on the scene, people have adjusted its design many times. Ida Rosenthal, an immigrant from Russia, together with her husband, William, founded a company called Maidenform. She felt strongly that all women did not fit into the same bust size category and painstakingly grouped women into different categories (cup sizes) and engineered bras to fit females throughout all phases of life (from puberty to maturity).

Fashion trends have changed but the prevalent goal of the bra over the years is to construct an article that will lift and shape the breasts and hold them somewhat securely. Generally speaking, it is desired to raise the lift of the breasts to create an appearance of larger, firmer and fuller breasts. In addition, for fashion purposes, it is often desired to enhance "cleavage" by pushing the breasts closer to each other. However, even though bras have been available for many years and featured a variety of forms, modern bras remain inadequate in achieving fashion and appearance goals while still being comfortable. This is because most conventional bras lift and shape the breasts, but do so in a way that actually compresses them against the woman's chest. Accordingly, although they may be higher and better shaped, comfort is compromised. In addition, while lift and cleavage may be enhanced in a conventional bra, the breasts may actually be reduced in size or projection from a profile perspective due to the compression of the bra. What is needed is a bra apparatus which provides an improvement for the breasts in all three desired fields of movement; namely lifting the breasts, orienting them closer together for cleavage enhancement and projecting them forward away from the chest.

In addition to projection, most conventional bras are inadequate because they feature two cups that cannot be independently adjusted to an adequate degree. For most women, the two breasts are not identical in size and for some the difference is more pronounced due to nature or due to injury. Accordingly, it may be desired to lift and shape one breast more than the other. In a conventional bra, the only means of providing such adjustment is to adjust the shoulder strap which has the affect of loosening or tightening the apparatus. What is needed is a means of adjusting the lift of one or both breasts independently, without the need for adjusting the shoulder straps.

DESCRIPTION OF THE PRIOR ART

A search of prior patents reveals numerous patented bras for supporting and shaping breasts for cosmetic as well as medical reasons. U.S. Pat. No. 2,621,328 by Duchnofskey is for an appliance intended to attach to a bra to improve the capabilities of the bra. The invention uses breast support elements mounted on a band that attaches to the bra. This band is of a length corresponding to the width of the frontal portion of the bra running across the chest of the wearer. The band is positioned below the breasts and attaches to the bra at several points including at the ends of the band and in the middle of the chest between the breasts. The band is attached with securing elements fixed to the bra which may be part of the bra when sold or attached to a bra after purchase. The support elements have flat tabs which fit into receiving pockets on the band. The receiving pockets are aligned with the centers of the bra cups. The support elements, which may be formed of any suitably stiff material, generally have a half-cup shape to support the breasts on their underneath side and the tabs are at essentially ninety degrees to the body of the support elements, so that the support elements are held extending away from the chest band and the body of the wearer. The band attaches to the bra and locates the pockets. The pockets hold and locate the tabs which support and position the support members. The cup portion of the support members can be padded for comfort or additional lifting of the breasts.

U.S. Pat. No. 2,468,106, by Polk et al., also claims a support that is attached to a bra to provide lift and shape to the breasts. The support is made of plastic or other resilient, shapable material and may be a single piece or have an individual piece per each breast. The single piece support has laterally directed tabs at each end at the lower corners with a downwardly directed tab at its middle. The two piece supports only have horizontally directed tabs at the lower corners The tabs insert through loops on the bra to hold the support within the bra. The upper portions of the support may be anchored to the bra with ribbons that pass through the supports. The supports have slits in them to allow the ribbons to pass through the supports, and the ends of the ribbon are sewn or otherwise attached to the bra to anchor the supports. Generally, the lower portions of the support are shaped to conform to the body, while the upper portions are shaped to support, lift, and shape the breasts.

U.S. Pat. No. 2,915,067 by Bracht uses a stiffening element incorporated directly into the lower portion of the bra cups. The stiffening element is made of relatively stiff resiliently flexible non-stretchable plastic and is cut in a pattern to provide flexibility in one direction but stiffness in another. In particular, the stiffening element is cut to allow it to curve beneath the breast while retaining a stiffer supporting capability as the element extends away from the body of the wearer. The stiffening element is adhesively sandwiched between two layers of relatively thin, spongy material and the resulting composite element is sewn into the bra cups in a fashion that constrains the composite element in the shape of the lower portion of the bra cup. The stiffening element in the preferred embodiment consists of several tines in parallel with each other and connected by a least one band of material running cross ways to the tines. The tines are longest at the center where they align with the center of the breast and shorter at the edges of the group. The bands of material running cross ways to the tines are flexible enough to allow the curving of the element to shape the breast, while the tines are numerous enough to provide stiffness along their length to support the breast.

SUMMARY OF THE INVENTION

The present invention is a lift and/or push-out and/or cleavage enhancing system for a bra or other garment having breast cups or pockets accommodating the breasts. The lift system works within the breast cups of the garment with the means for adjusting the lift system extending outside the actual area of the breast cups in some embodiments. In those embodiments, the means for adjusting the lift system extends up straps rising up from the breast cups to which they are attached.

The lift system of the present invention has two core elements, each effective in its own right and capable of supplying the desired lift. However, combining the two elements achieves synergy, and some embodiments comprise both these elements. These core elements are a lift platform and a flexible shaping member.

A lift platform is located within each breast cup. The lift platform of one embodiment is an elongated member and has a curved shape to conform to the lower portion of the breast cup. The lift platform may be highly flexible, resilient approaching rigid, or somewhere in between. If it is desired that the lift platform be resilient, the material from which the lift platform is made determines the thickness required for the lift platform to have the resiliency desired for that embodiment. More flexible lift platforms may be as flexible as the flexible shaping member. The shape and location of the lifting platform puts the platform in the lower section of the breast cup where the lift platform supports the breast from beneath. The lift platform is open to the top portions of the breast cup to allow the breast to freely fill the upper portion of the breast cup and any other garment present.

The mechanics of lift entail attaching one end of the lift platform to the breast cup and attaching a connecting member to the other end of the lift platform. Moving the connecting member lifts the end of the lift platform, suspending the lift platform between the connecting member and where the lift platform attaches in the breast cup, and changes the amount of lift given to the breast. Because this connecting member transmits lift adjustments to the lift platform, this connecting member may also be described as an adjusting member. The particular location where the lifting platform attaches to the breast cup determines the direction of lift. In one embodiment, the connecting member is an elongated member with an anchor element attached to the end opposite to the end where the lift platform attaches to the connecting member, and the connecting member extends outside the breast cup, where the anchor element attaches to a strap, or somewhere else on the garment.

The flexible shaping member, in one embodiment, is also a thin member like the lift platform, but it is oriented in the breast cup more towards the side of the wearer and has a larger surface area. The flexible shaping member is located within the breast cup, and in the initial "at rest" position, the flexible shaping member lines a portion of the inside surface of the breast cup from the upper corner near the shoulder, down that side to the underside of the breast, and on to near the center of the chest. In that position the flexible shaping member supports the lower and outside areas of the breast. In one embodiment, the flexible shaping member is attached to the breast cup in the area of the upper corner near the shoulder.

When actuated to lift the breast, the flexible shaping member is flexed from its "at rest" position upwards and toward the center of the chest. The flexible shaping member lifts the breast up and towards the center as well as projects it forward from the body. This accentuates the cleavage and increases the apparent size of the breast. The section of the flexible shaping member along the side prevents the breast from bulging out the side of the bra while the breast is lifted.

There are several methods of actuating the flexible shaping member. In the one embodiment, it is a narrower lift platform, fixed at one end to the breast cup, that lifts and alters the flex of the flexible shaping member. Other embodiments might use a more flexible lift platform. The combination of the lift platform and flexible shaping member achieves a definite synergism, which shifts the breast upward and also projects it from the body of the wearer. The effect also shifts the breast towards the center of the chest to accentuate cleavage.

In one embodiment, the motion of the lift platform is controlled by a second connecting member. The second connecting member attaches at one end to the bottom of the bra cup and its other end attaches to the lift platform. As the first connecting member is moved, it causes the lift platform to suspend upward from the point where it attaches to the breast cup. The second connecting member constrains this motion to keep the lift platform near the body of the wearer. This ensures the platform provides lift to the breast and does not merely traverse up along the breast away from the body without lifting the breast. Because the second connecting member controls the motion of the lift platform, the second connecting member may also be thought of as a controlling member.

In another embodiment, a horizontal stabilizer and guide are associated with each lift platform to limit the horizontal displacement of the lift platforms. The horizontal stabilizer is a tab fixed to the lift platform and directed downward. The horizontal guide is a small flat pocket fixed to the lower edge of the breast cup or an under-wire and shaped for receiving the horizontal stabilizer. The horizontal guide limits the amount of horizontal travel of the horizontal stabilizer and this limits the amount of horizontal travel of the lift platforms as they are adjusted to different levels of lift. By this method, the lift platforms are kept closer to the body of the wearer and kept from pulling up along the breast.

As discussed above, the method and device of the present invention overcomes the disadvantages inherent in prior art methods and devices. In that respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Accordingly, those skilled in the art will appreciate that the conception upon which this invention is based may readily be utilized as a basis for the design of other structures, methods, and systems for carrying out the several purposes of the present invention. It is important, therefore, that the claims be regarded as including such equivalent constructions insofar as they do not depart from the spirit of the present invention.

Furthermore, the purpose of the foregoing Abstract is to enable the U.S. Patent and Trademark Office and the public generally, and especially including the practitioners in the art who are not familiar with patent or legal terms or phraseology, to determine quickly from a cursory inspection, the nature and essence of the technical disclosure of the application. The Abstract is neither intended to define the invention of the application, nor is it intended to be limiting to the scope of the invention in any way.

BRIEF DESCRIPTION OF THE DRAWINGS

Additional utility and features of the invention will become more fully apparent to those skilled in the art by reference to the following drawings, which illustrate the primary features of numerous embodiments.

DETAILED DESCRIPTION OF EMBODIMENTS OF THE INVENTION

The detailed description below of embodiments of the present invention is intended to explain the current invention. It is to be understood that a variety of other arrangements are also possible without departing from the spirit and scope of the invention. The lift system of the present invention functions upon the structure of any garment having breast cups. The description of the embodiments below focuses on the lift system being installed in bras. However, it should be understood that any garment fitting the female figure closely enough to have breast cups could incorporate the lift system or have the lift system built into it. In the descriptions that follow below, where appropriate, the same numbers may be used in different illustrations.

Figure 1:
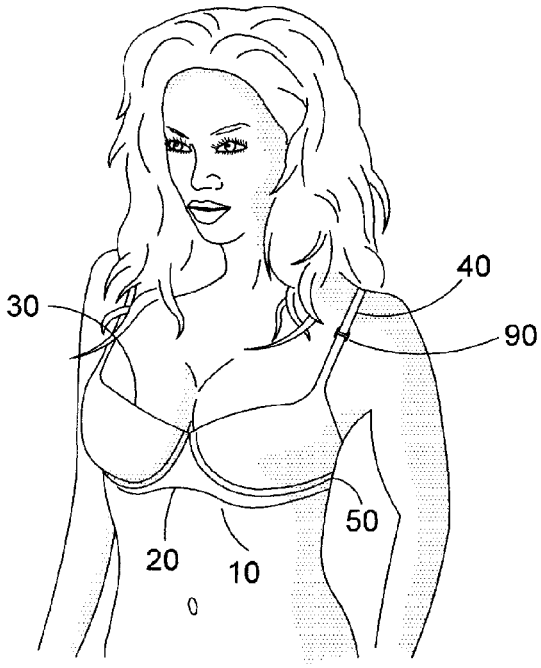
FIG. 1 shows the bra of the present invention being worn.
Figure 3:
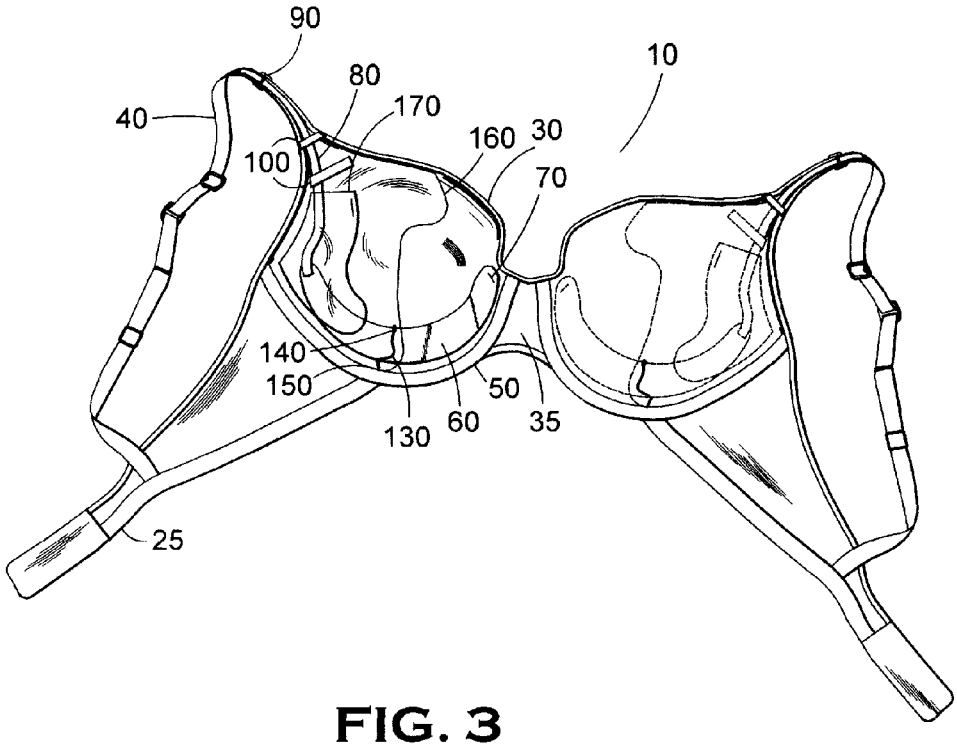
FIG. 3 shows the uncovered lift system of FIG. 2 in an "at rest" position.

FIG. 1 shows a bra 10 having the lift system of the current invention being worn. To general outward appearance, the bra looks essentially the same as a bra without the lift system. However, the present invention allows the amount of lift of the bra to be adjusted generally independent of any adjustment allowed by the shoulder straps with each side of the bra being capable of independent adjustment. The bra in FIG. 1 illustrates a common configuration of a typical bra which includes: a chest band 20 that wraps around the torso; breast cups 30 attached to the front of the chest band, or incorporated into the front of the chest band; shoulder straps 40, which attach to the breast cups 30, pass over the shoulders, and attach to chest band 20 in the back, and; for some bras 10, an under-wire, or frame, 50 that is incorporated into the bra 10 at the junction of the chest band 20 and breast cups 30 and which partially encircle the breasts on the bottom side. Frame, or under-wire, 50 may be made of any material sufficiently rigid to maintain the lower contour of breast cups 30. Breast cups 30 may be made of more than one layer with some of those layers possibly made of a thicker padding material, or thicker padding material may be inserted between layers. Also, some layers, such as a padding layer, may extend over only a portion of breast cup 30 as it is not necessary that all layers cover the same area. The rest of the figures, as can best be seem in FIG. 3, show another common configuration of bras which includes: back bands 25, which connect at the back of a wearer and extend around the torso toward the front; breast cups 30 to which the back bands 25 attach; shoulder straps 40, which attach to the breast cups 30, pass over the shoulders, and attach to back bands 25 at the back of the wearer; a central panel 35 that connects the breast cups 30 at the front of the wearer, and; for some bras 10, an under-wire, or frame, 50 that is incorporated into the bra 10 at the lower periphery of the breast cups 30 and which partially encircle the breasts on the bottom side. The latter configuration utilizes the breast cups 35 as elements integral to the structure of bra 10. This configuration can also have multiple and partial layers of material in breast cups 30. The method of lift of the present invention works with both these configurations as well as others and generally lifts the breasts toward each other and upward and away from the body. This avoids undesired compression of the breasts while providing lift and projection from the body of the wearer, as well as emphasizing cleavage.

Figure 2:
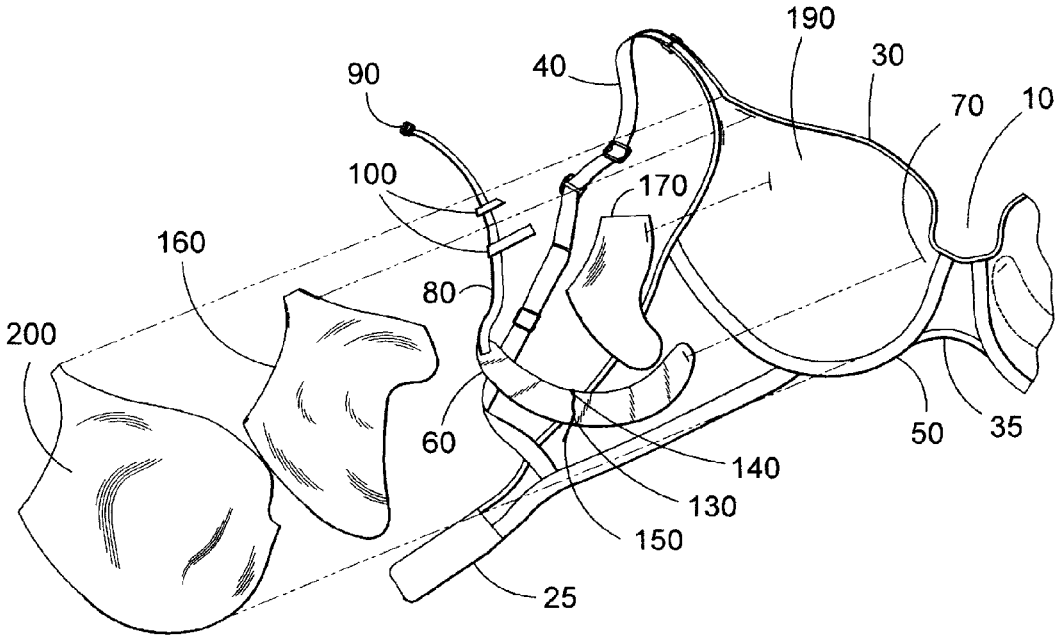
FIG. 2 is an exploded view of an embodiment of the lift system from the internal side of the breast cup.

FIG. 2 is an exploded view of the lift system from the internal side of breast cup 30, while FIG. 3 shows the elements nested into breast cup 30 in an "at rest" position, but without any covering material. Referring to both FIG. 2 and FIG. 3, one of the main lifting elements of the system is lift platform 60, which is attached to bra 10 toward the center of bra 10 at point 70. To lift the breast, lift platform 60 suspends from point 70, up and away from the bottom of breast cup 30 near frame, or under-wire, 50. This displaces the breast generally from lower in breast cup 30 to higher in breast cup 30 as well as away from the wearer's body and toward the center of the chest.

Connector 80 is attached to lift platform 60 at the free moving end of lift platform 60 and it is the means by which lift platform 60 is suspended to create the lift. Connector 80, in this embodiment, performs its function under a tensile load and therefore may be constructed of light, flexible material such as nylon strand or tether. Connector 80 passes unexposed from lift platform 60 up until it exits the interior of breast cup 30 under shoulder strap 40 where it travels along shoulder strap 40 until it attaches to sliding anchor 90 mounted on shoulder strap 40. Sliding anchor 90 is also visible in FIG. 1, but connector 80 is still essentially concealed by shoulder strap 40 as shown in FIG. 1. Sliding anchor 90 is adjustable to different positions along shoulder strap 40 but is capable of holding its position once manually placed. In one embodiment, sliding anchor 90 has teeth formed in it and it is these teeth which protrude into shoulder strap 40 to maintain the position of the sliding anchor 90, connector 80, and lift platform 60.

The path of connector 80 is constrained by guide loops 100 which are flattened loops attached to breast cup 30 and shoulder strap 40. These guide loops 100 keep connector 80 aligned with shoulder strap 90, define its path, and keep it from becoming tangled. Connector 80 may be located between layers if there are multiple layers, and guides 100 may attach to more than one layer, especially where some layers do not cover the exact same area of breast cup 30. It is even possible that connector 90 could pass from one side of a layer through an aperture in the layer to the other side of the layer. In this case the aperture itself may act as a guide.

As stated above, lift platform 60 is fixed to breast cup 30 at point 70 from which it suspends when moved by connector 80. If lift platform 60 is of the more resilient type, it performs somewhat like a lever to lift the breast with the fulcrum of the lever being at point 70. In this case, lift platform 60 is constructed resilient enough to lift the breast in this way, with the particular material used determining how thick lift platform 60 needs to be. However, lift platform 60 need not be rigid and may be constructed of highly flexible material. In that case lift platform 60 performs like a sling, suspended at its ends and supporting a load in between. The surface area of lift platform 60 may also vary greatly depending on the size of breast cup 30 and whether lift is desired more than projection from the body, or the reverse. The shape of lift platform 60 is influenced by where point 70 is located in breast cup 30, the structural configuration of the bra, or garment and other factors, such as the preferred change in the breast position as just mentioned. Lift platform 60 could be located between layers of a multilayer breast cup with point 70 being on an exterior or non-exterior layer, either one. Alternative embodiments may even utilize a lift platform that is thin and flexible, similar to flexible shaping member 160.

Figure 4:
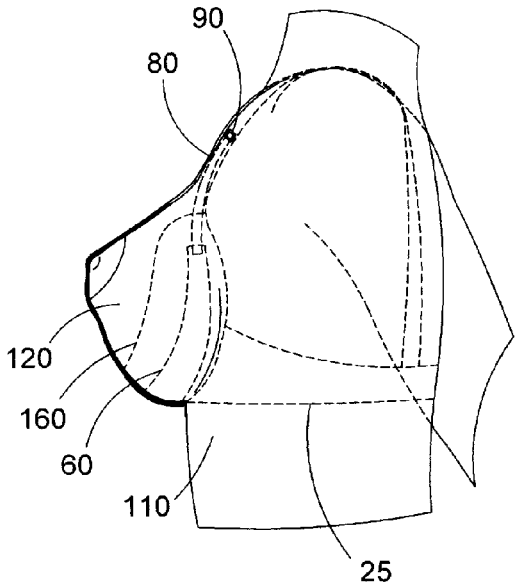
FIG. 4 is a side view cutaway of the lift system of FIG. 2 and breast in an "at rest" position.
Figure 5:
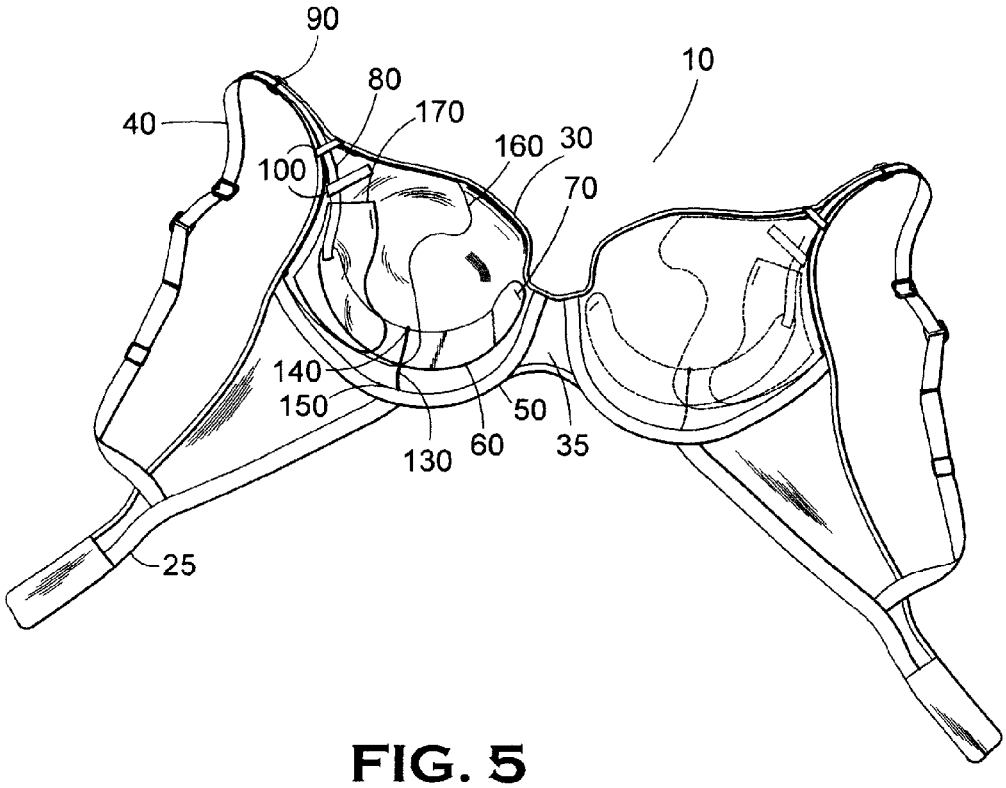
FIG. 5 shows the uncovered lift system of FIG. 2 in a lifted position.
Figure 6:
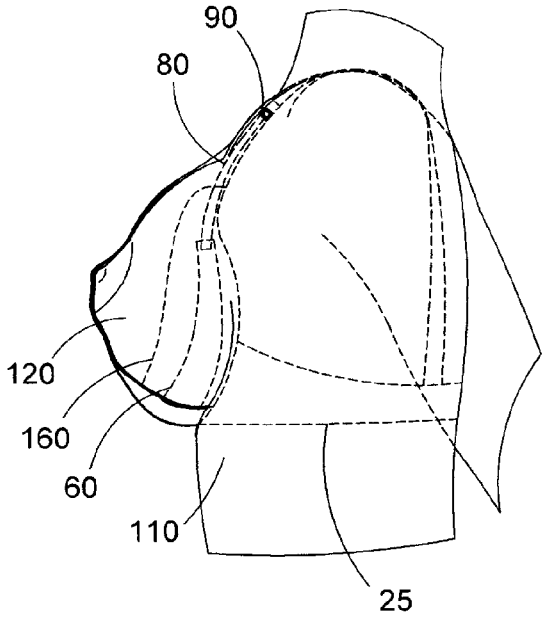
FIG. 6 is a side view cutaway of the lift system of FIG. 2 and breast in a lifted position.

FIG. 4 and FIG. 6 illustrate profile views of the lift system and breast 120. To provide the most desirable effect when it lifts, lift platform 60 should remain close to the body 110 of the wearer as it lifts, rather than move along the contour of breast 120. Lift platform 60 may be seen in its "at rest" position relative to body 110 in FIG. 4 and in its lifted position relative to body 110 in FIG. 6. Returning to FIG. 2 and FIG. 3, the path of lift platform 60 is controlled and defined by lift guide 130. Lift guide 130 causes lift platform 60 to stay close to the body 110 as lift platform 60 is actuated by connector 80. This ensures that the motion of lift platform 60 provides lift and does not merely slide up along breast 120. In this embodiment lift guide 130 works under a tensile load and therefore may be constructed from nylon strand or similar flexible material and will be a tensile member having two ends. Since it controls the motion of lift platform 60, lift guide 130 may also be thought of as a controlling member. Its attachment between lift platform 60 and the lower structure of the garment means that "connecting member" is also a valid descriptor. A first end 140 of lift guide 130 is attached to lift platform 60 and a second end 150 is anchored to bra 10 at the bottom of cup 30 near under-wire, or frame, 50, or if bra 10 has the general structure shown in FIG. 1, near chest band 20. Frame, or under-wire, 50 may be made of any material sufficiently rigid to maintain the lower contour of breast cups 30. As connector 80 elevates lift platform 60, lift guide 130 limits the degree of freedom lift platform 60 has to move away from body 110. In FIG. 3 lift guide 130 is slack and somewhat coiled, while FIG. 5 shows lift guide 130 taut and restraining lift platform 60. This provides the desired lift for more of breast 120 as shown in FIG. 6.

Figure 7:
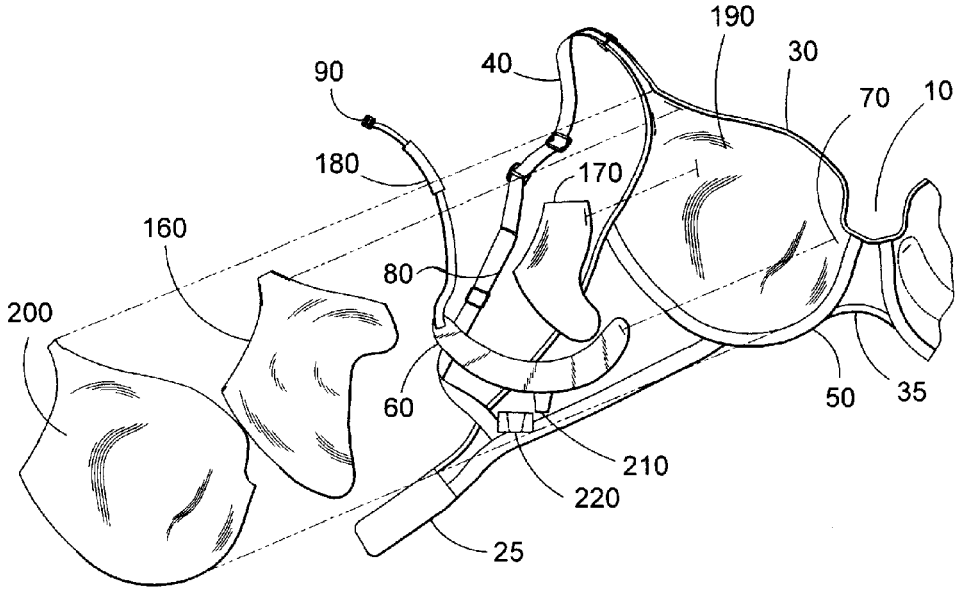
FIG. 7 is an exploded view of another embodiment of the lift system from the internal side of the breast cup.

Turning now to flexible shaping member 160 of this embodiment, it can be most easily seen in FIG. 2, the exploded view of this embodiment, as well as FIG. 7, the exploded view of another embodiment. As shown in these figures, cover layer 200 covers flexible shaping member 160 and keeps it from making direct contact with the wearer. As shown in FIG. 3, as well as corresponding FIG. 8, flexible shaping member 160 lays into the lateral area, as opposed to the central area, of breast cup 30 and is covered in the interior of breast cup 30 by cover layer 200. Flexible shaping member 160 is held in location at its upper corner where it extends toward shoulder strap 90. This leaves a great deal of flexible shaping member 160 free to flex and lift. In this embodiment, flexible shaping member 160 is made of thin plastic sheeting of a thickness making it highly flexible, but retaining the ability to support and lift breast 120. It is possible that another class of material other than plastic may be used. Despite its thinness and flexibility, when actuated, flexible shaping member 160 is capable of displacing the breast from lower in breast cup 30, upwardly and centrally, to also project from the body. Displacing the breasts centrally toward each other enhances cleavage. Because of its flexibility, flexible shaping member 160 forms to the breast as it lifts it, and thus preserves a natural shape. The location of flexible shaping member 160 in the lateral area of breast cup 30 prevents the breast from bulging unnaturally out the side of breast cup 30. In this embodiment, it is lift platform 60 that actuates flexible shaping member 160, while flexible shaping member 160 facilitates the movement of lift platform 60 within the cloth confines of breast cup 30 and further broadens and distributes the lifting effect of lift platform 60. Due to its also performing the functions of facilitating the motion of lift platform 60 and distributing the lifting effect, flexible shaping member 160 may also be thought of as a smoothing shield similar to smoothing shield 170 discussed below. However, flexible shaping member 160 would be performing the smoothing functions between lift platform 60 and the wearer of the garment.

Smoothing shield 170 is located on the side of lift platform 60 facing away from the wearer between lift platform 60 and cup panel 190. It's location in relation to the other elements of the lift system can best be seen in FIG. 2, while its location within the breast cup can best be seen in FIG. 3. Smoothing shield 170 performs at least two functions. Similarly to flexible shaping member 160, smoothing shield 170 eases the movement of lift platform 60 through a pliant cloth environment. In addition to that, smoothing shield 170 maintains a smooth outer surface on cup 30 and prevents lift platform 60 from distorting the cosmetic appearance. This is particularly important at the moving end of lift platform 60 where connector 80 attaches, and as can be seen in FIG. 3, smoothing shield 170 is located in the area where the moving end of lift platform 60 travels. Smoothing shield 170 may be anchored at any location that does not hinder lift platform 60, and lift guide 130, and smoothing shield 170 may also have more than one layer of material between it and the outer most layer of cup panel 190.

Now, the location and function of the individual elements having been described, their interaction will briefly be described. When being worn, and before lift is actuated, lift platform 60 is located along the bottom arc of breast cup 30. The end of lift platform 60 that is near the center of the chest is fixed to breast cup 30 at point 70. The other end of lift platform 60, near the side of the chest, has connector 80 attached to it. Smoothing shield 170 is located at that end of the lift platform 60 and is on the opposite side of lift platform 60 from the wearer. Flexible shaping member 160 covers a good part of breast cup 30 toward the side of the chest. Looking at FIG. 4, it can be seen that, in the un-lifted position, flexible shaping member 160 conforms to breast 120 and is pressed out into breast cup 30 by breast 120. Connector 80 runs from where it is attached to lift platform 60 up across breast cup 30 until it exits the side of breast cup 30 that is next to the wearer, and passes up shoulder strap 40, where it terminates at sliding anchor 90 on shoulder strap 40. Connector 80 is concealed while it makes this traverse and is visible only after it passes outside of the area of breast cup 30, and only then to the extent that shoulder strap 40 does not conceal it. Under normal circumstances, connector 80 is not visible to an observer, even when the garment having breast cup 30 is not covered by another garment. To actuate lift, sliding anchor 90 is adjusted further up on shoulder strap 40. Connector 80 is moved with slider anchor 90 and pulls upward on lift platform 60 which suspends from point 70. Because connector 80 transmits lift adjustments to the lift platform, it may also be considered an adjusting member. As lift platform 60 moves upward, it lifts flexible shaping member 160, and they have sliding contact with each other as they both lift breast 120 up, towards the center of the wearer's chests and away from the wearer's body. Lift guide 130 controls the motion of lift platform 60, keeping lift platform 60 close to the body of the wearer, ensuring that the system elements lift breast 120 instead of merely adjusting over the surface of breast 120. Smoothing shield 170 facilitates the motion of lift platform 60 and prevents it from distorting the outward appearance of breast cup 30.

Generally, the working elements of the lift system will be surrounded by layers of pliant flexible material, or cloth, such as cup panel 190 and cover layer 200 shown in FIG. 2. Layers of pliant flexible material may also be interspersed between the working elements of the lift system, particularly if an interspersed layer does not cover the entire area of breast cup 30. These layers may prevent connector 80 from becoming tangled with the other elements and will also smooth the outward appearance of the lift system. In particular, multiple layers of material may form the outermost cup panel 190 covering the outermost elements of the lift system to enhance the natural look of the lifted breast 120.

Figure 8:
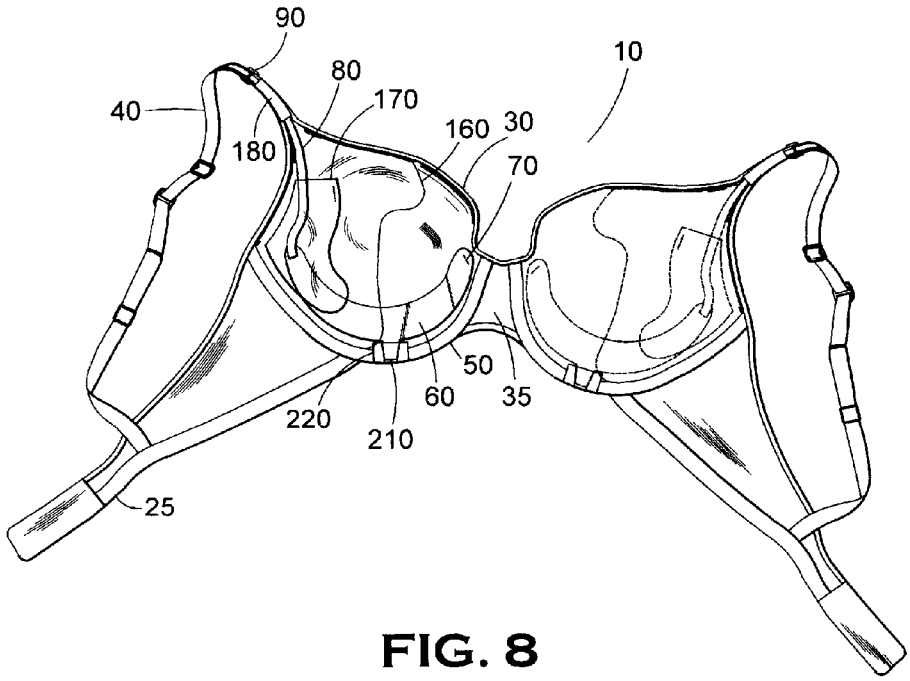
FIG. 8 shows the uncovered lift system of FIG. 7 in an "at rest" position.
Figure 9:
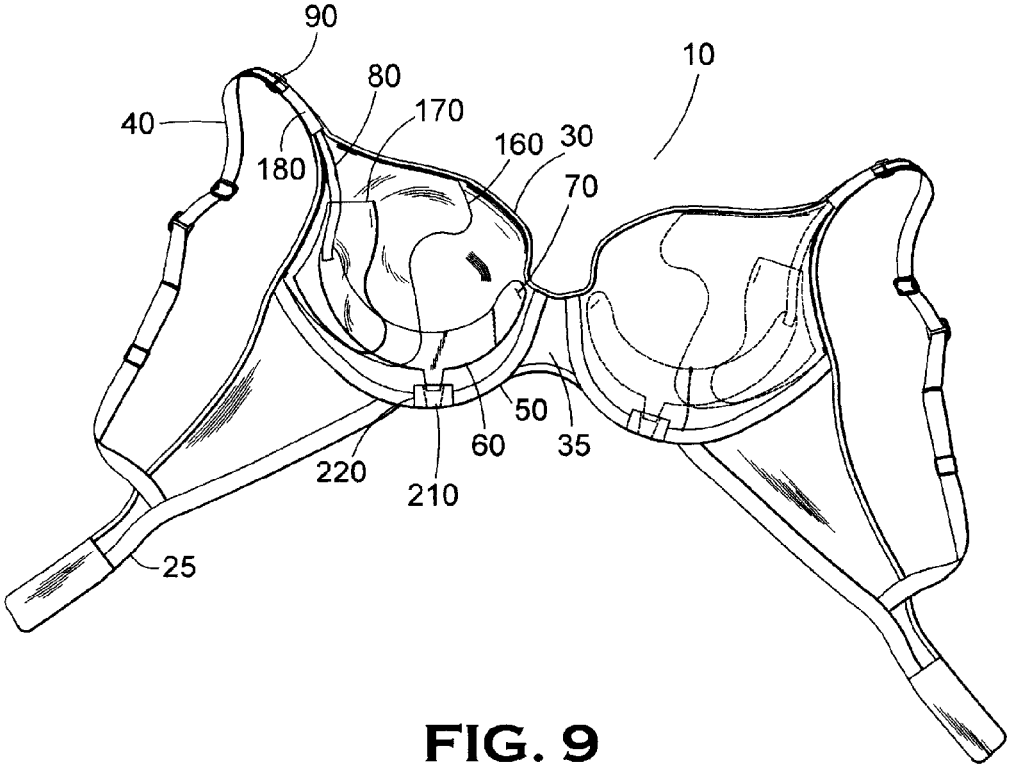
FIG. 9 shows the uncovered lift system of FIG. 7 in a lifted position.

FIG. 7, FIG. 8, and FIG. 9 feature an alternative embodiment of the present invention. FIG. 8 shows the embodiment in an "at rest" position, while FIG. 9 shows the embodiment in a lifted position. The differences between this embodiment and the embodiment described above relate to how connector 80 is guided and how the horizontal displacement of lift platform 60 is controlled.

FIG. 7, FIG. 8, and FIG. 9 feature an alternative embodiment of the present invention. FIG. 8 shows the embodiment in an "at rest" position, while FIG. 9 shows the embodiment in a lifted position. The differences between this embodiment and the embodiment described above relate to how connector 80 is guided and how the horizontal displacement of lift platform 60 is controlled.

The alternative embodiment shown in FIG. 7, FIG. 8, and FIG. 9 utilizes stabilizer tab 210 and stabilizer guide 220 to control the motion of lift platform 60 as it lifts. Stabilizer tab 210 is a tab attached to lift platform 60 and directed essentially vertically downward from the edge of lift platform 60 nearest the wearer. Attached to the bottom edge of breast cup 30 is stabilizer guide 220, which is shaped with a pocket or channel into which stabilizer tab 210 inserts. As shown in FIG. 8, when lift platform 60 is in an at rest position, stabilizer tab 210 inserts more fully into stabilizer guide 220. In the lifted position of FIG. 9, stabilizer tab 210 is partially drawn from stabilizer guide 220. The continued engagement of stabilizer tab 210 in stabilizer guide 220 keeps lift platform 60 closer to the body 110 of the wearer instead of sliding upward on breast 120. The effect of this is shown in FIG. 4 and FIG. 6. Flexible shaping member 160 distributes the lift to more of breast 120.

Stabilizer tab 210 is most likely an integral part of lift platform 60 and made of the same material as lift platform 60 but may also be a different material. This may be accomplished, for example, by inserting a metallic stabilizer tab 210 into the mold used to mold lift platform 60 from its material of flexibly resilient plastic. Similarly, stabilizer guide 220 may be fixed to cup 30 in various ways or may, in the alternative, be incorporated into a structural member such as under-wire 50.

Figure 10:
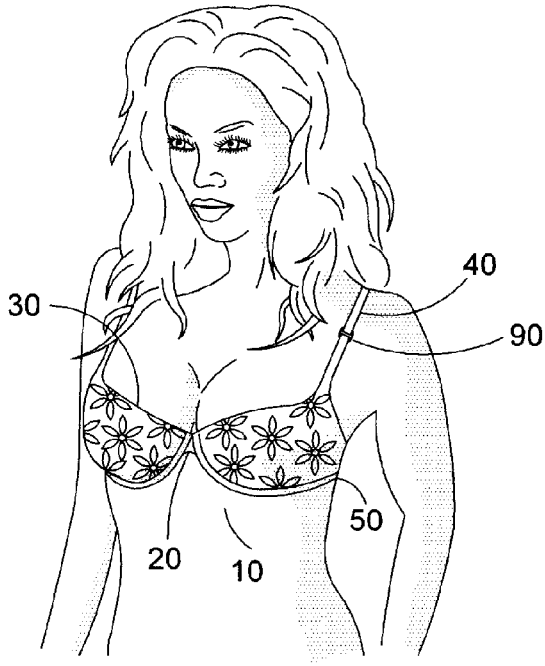
FIG. 10 shows a swimsuit top incorporating an embodiment of the invention.
Figure 11:
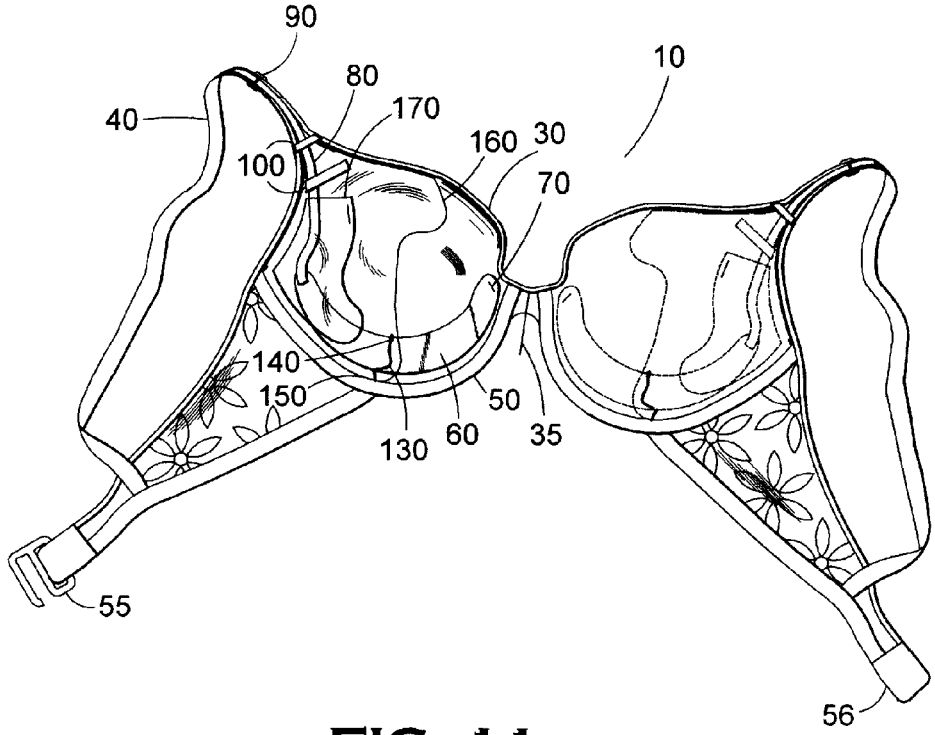
FIG. 11 shows a swimsuit top with an uncovered embodiment of the lift system in an "at rest" position.
Figure 12:
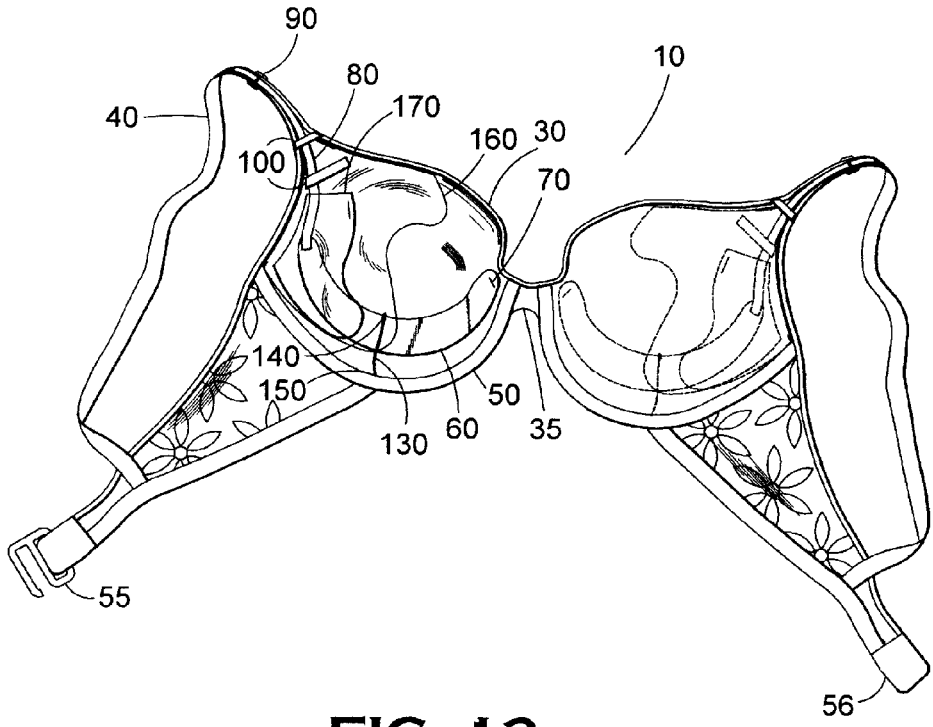
FIG. 12 shows a swimsuit top with an uncovered embodiment of the lift system in a lifted position.

FIG. 10 shows a swimsuit top incorporating a lift system according to the present invention. The discreteness of the lift system allows a totally exposed garment to have the system and the system be unnoticeable except for its results. Referring to FIG. 11 and FIG. 12, all of the elements present in the embodiments shown in FIG. 2, FIG. 3 and FIG. 5 may also be seen in the swimsuit top, and they function the same. In FIG. 11 and FIG. 12 it can be seen that the method of fastening the swimsuit top is typical to many swimsuit tops. A hook 55 is attached to one back band 25 while a loop 56 is sewn at the end of the opposing back band. Hook 55 engages loop 56 to hold the swimsuit top on the wearer.

Having provided detailed descriptions of embodiments of the invention, it should be noted that there are many ways to vary the elements of these embodiments and remain within the spirit and scope of the present invention. The connector tube 180 need not be exclusive to the embodiments with which it was discussed and may be used in conjunction with the guide loops 100 discussed with respect to other embodiments. Similarly guide loops 100 may be used in the alternative embodiment of FIG. 7, FIG. 8, and FIG. 9. In addition to those changes, means of limiting the horizontal displacement of lift platform 60 may also be varied. The dynamic interaction of lift platform 60 and flexible shaping member 160 and/or smoothing shield 170 may be used for this purpose. This may be accomplished by limiting or constraining the relative motion between these elements. As an example, if lift platform 60 and flexible shaping member 160 may only move relative to each other in a direction along the length of lift platform 60 or along their edges, flexible shaping member 160 will keep lift platform 60 from sliding up breast 120. Additionally, lift platform 60, flexible shaping member 160, and smoothing shield 170, may all be constructed of more than one piece and still accomplish their respective purposes. It should be obvious from this that there are numerous embodiments subsumed in the present invention and the scope of this invention should not be limited by the discussion of the embodiments above.

Also, depending on the direction of lift desired, specifics of the present invention may be altered. For example, the particular location within breast cup 30 of point 70 affects the motion of lift platform 60, and the resulting effects of lift adjustments. Similarly, the arrangement and location of flexible shaping member 160 and other smoothing shields will affect the direction of lift and the shape of breast 120. Depending on the type of lift platform 60 and its location, connector 80 may be guided on different paths to allow smooth operation of the lift system. The location and type of anchor may change as well. These variations are only different embodiments of the invention claimed herein.

I claim:

1. A lift system for use in supporting a breast within a breast cup of a garment, the lift system comprising:

a garment having at least one breast cup, said breast cup comprising more than one layer of material so that there is at least an innermost layer and an outermost layer, and when said garment is worn, said breast cup being positioned on a wearer's chest to extend generally horizontally from approximately the center of a wearer's chest to the side of a wearer's chest and positioned at a height to support a breast, said breast cup having a bottom periphery beneath said breast, a lift platform situated within said breast cup, said lift platform attached at a first point on said lift platform to said breast cup at a location nearer the center of a wearer's chest, said lift platform being located between a wearer's breast and said outermost layer of said breast cup and, in an unadjusted position, along said bottom periphery; and adjusting means attached to said lift platform at a second point distal from said first point on said lift platform, said second point on said lift platform being, in said unadjusted position, nearer the side of a wearer's chest, wherein said adjusting means rotates said lift platform about said location in said breast cup nearer the center of a wearer's chest, moving said second point on said lift platform higher in said breast cup.

2. The lift system of claim 1, further comprising:

a frame located along said bottom periphery of said breast cup, said frame maintaining said bottom periphery of said breast cup in the same shape, when said lift platform is moved from said unadjusted position.

3. The lift system of claim 1, wherein said adjusting means comprises:

a first connecting member having a first end and a second end, and;

an anchor movably mounted on said garment, wherein;

said first end of said first connecting member is attached to said lift platform at said second point and said second end of said first connecting member is attached to said anchor, and;

said anchor may be moved from place to place on said garment.

4. The lift system of claim 3, wherein:

said anchor is a sliding anchor mounted on a shoulder strap rising from said breast cup, said sliding anchor being capable of adjustment along said shoulder strap.

5. The lift system of claim 3, further comprising:

one or more guides for said first connecting member.

6. The lift system of claim 5, wherein:

said one or more guides comprises one or more loops attached to said garment.

7. The lift system of claim 1, wherein said lift platform comprises:

one or more pieces of thin material sized to fit within said breast cup and, furthermore, generally shaped to fit said bottom periphery of said breast cup when said lift platform is in said unadjusted position along said bottom periphery of said breast cup.

8. The lift system of claim 1, further comprising:

a flexible shaping member, said flexible shaping member being at least partially interposed between said lift platform and a wearer's breast, and said flexible shaping member being attached to said breast cup in at least one location to maintain said flexible shaping member's location within said at least one breast cup.

9. The lift system of claim 1, further comprising:

control means operatively associated with said lift platform for further controlling the motion of said lift platform.

10. The lift system of claim 9, wherein said control means comprises:

a first controlling member having a first end and a second end, wherein;

said first end of said first controlling member is attached to said garment and said second end of said first controlling member is attached to said lift platform.

11. The lift system of claim 9, wherein said control means comprises:

a flexible shaping member, said flexible shaping member being at least partially interposed between said lift platform and a wearer's breast, and said flexible shaping member being attached to said breast cup in at least one location to maintain said flexible shaping member's location within said at least one breast cup.

12. The lift system of claim 1, further comprising:

a smoothing shield at least partially interposed between said lift platform and the outermost layer of said breast cup, said smoothing shield being attached to said garment at one or more locations and said smoothing shield comprised of one or more pieces of thin material.

13. The lift system of claim 1, wherein: said garment comprises a bra.

14. The lift system of claim 1, wherein:

said garment comprises a swimsuit.

* * * * *